US005893544A

United States Patent [19]

Chen

[11] Patent Number: 5,893,544

[45] Date of Patent: Apr. 13, 1999

[54] POSITIONING DEVICE FOR A SUSPENSION RACK

[76] Inventor: Antony Chen, No. 863, Chienhsing Rd., North Dist., Taichung, Taiwan

[21] Appl. No.: 09/007,310

[22] Filed: Jan. 15, 1998

[51] Int. Cl.[6] ..... A47B 96/06

[52] U.S. Cl. ..... 248/220.21; 248/488

[58] Field of Search ..... 248/220.21, 222.51, 248/309.1, 316.1, 466, 475.1, 488, 544; 211/85.31, 87.01, 126.9; 403/118, 186, 289, 299, 348

[56] References Cited

U.S. PATENT DOCUMENTS

| | | | |
|---|---|---|---|
| 2,785,506 | 3/1957 | Ragazzo | 248/220.21 |
| 2,951,668 | 9/1960 | Peterka | 248/488 |
| 3,049,323 | 8/1962 | Peterka | 248/488 |
| 3,133,719 | 5/1964 | Beck | 248/316.1 |
| 4,103,780 | 8/1978 | Winfree, Jr. | 248/316.1 |

*Primary Examiner*—Ramon O. Ramirez
*Assistant Examiner*—Robert Lipcsik
*Attorney, Agent, or Firm*—Kirkpatrick & Lockhart LLP

[57] ABSTRACT

A positioning device includes a base disk including a first side, a second side, and an outer periphery formed with an outer thread, two juxtaposed lugs each formed on the first side of the base disk and each including a flat abutting edge in line with each other, a channel defined between the two lugs, a compression ring fixedly mounted on the base disk and including an inner periphery formed with an inner thread threadedly engaged on the outer thread, and a decorative plate fitted on the compression ring.

7 Claims, 5 Drawing Sheets

POSITIONING DEVICE FOR A SUSPENSION RACK

FIELD OF THE INVENTION

The present invention relates to a positioning device, and more particularly to a positioning device for a wall suspension rack.

BACKGROUND OF THE INVENTION

A conventional positioning device for positioning a wall suspension rack to a vertical wall is shown in FIG. 5, and a complete illustration will follow in the detailed description of the preferred embodiments.

The present invention has arisen to mitigate and/or obviate the disadvantage of the conventional positioning device.

SUMMARY OF THE INVENTION

In accordance with one aspect of the present invention, there is provided a positioning device comprising a base disk including a first side, a second side, and an outer periphery formed with an outer thread, two juxtaposed lugs each formed on the first side of the base disk and each including a flat abutting edge in line with each other, and a channel defined between the two lugs, a compression ring fixedly mounted on the base disk and including an inner periphery formed with an inner thread threadedly engaged on the outer thread, and a decorative plate fitted on the compression ring.

Further features of the present invention will become apparent after a careful reading of the detailed description with appropriate reference to the accompanying drawings.

DETAILED DESCRIPTION OF THE PREFERRED EMBODIMENTS

Figure 5:
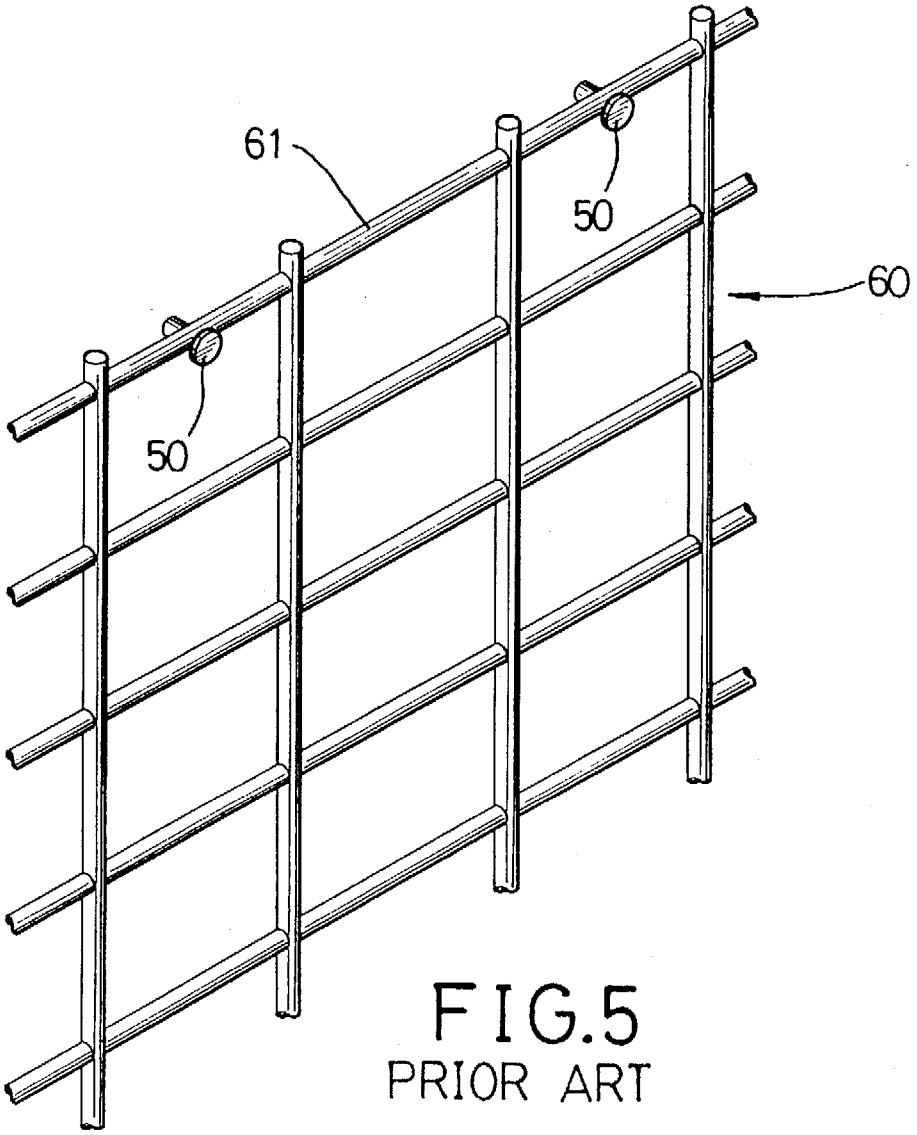
FIG.5 PRIOR ART
FIG. 5 is a perspective assembly view of a conventional positioning device for a suspension rack in accordance with the prior art.

For a better understanding of features and benefits of the present invention, reference is now made to FIG. 5, illustrating a conventional positioning device according to the prior art.

The conventional positioning device can be adapted for positioning a wall suspension rack 60 to a vertical wall (not shown) and comprises a plurality of positioning nails 50 made of steel each hammered into the vertical wall for supporting and positioning a horizontal bar 61 of the wall suspension rack 60 to the vertical wall.

By such an arrangement, each of the positioning nails 50 cannot provide a gripping force for efficiently clamping the horizontal bar 61 of the wall suspension rack 60 such that the wall suspension rack 60 easily detaches from the positioning nails 50 to fall to the ground, thereby causing an inconvenience and possibly injuring a user.

In addition, each of the positioning nails 50 is exposed to surroundings, thereby greatly decreasing the aesthetic quality of the wall suspension rack 60.

Referring now to FIGS. 1–4, a positioning device 10 in accordance with the present invention can be adapted for supporting and positioning a wall suspension rack 30 to a vertical wall 20.

The positioning device 10 comprises a base disk 11 including a first side 112, a second side 114, and an outer periphery formed with an outer thread 110.

Two juxtaposed lugs 12 are each formed on the first side 112 of the base disk 11 and each include a flat abutting edge 120 in line with each other. Each of the two lugs 12 abuts on the vertical wall 20 and a channel 13 is defined between the two lugs 12.

Each of the two lugs 12 transversely defines a plurality of holes 121 each extending through the base disk 11, and a plurality of positioning nails 21 each extend through a corresponding one of the holes 121 and are each partially inserted into the vertical wall 20.

Each of the two lugs 12 further transversely defines a bore 123 extending through the base disk 11, and two positioning screws 23 each extend through the bore 123 of a corresponding one of the two lugs 12, and are each screwed into the vertical wall 20.

A compression ring 14 is fixedly mounted on the base disk 11 and includes an inner periphery formed with an inner thread 140 threadedly engaged on the outer thread 110.

A decorative plate 15 is fitted on the compression ring 14. Alternatively, the decorative plate 15 is integrally formed with the compression ring 14.

Preferably, the decorative plate 15 is formed with an annular flange 16 rotatably fitted on an outer periphery of the compression ring 14.

In operation, a plurality of positioning devices 10 can be mounted on the vertical wall 20 with the lugs 12 of each of the positioning devices 10 abutting on the vertical wall 20.

Each of the positioning nails 21 can then be hammered into the vertical wall 20 via each of the holes 121, and each of the positioning screws 23 can be screwed into the vertical wall 20 via each of the bores 123, thereby fixing the base disk 11 of each of the positioning devices 10 to the vertical wall 20.

Figure 4:
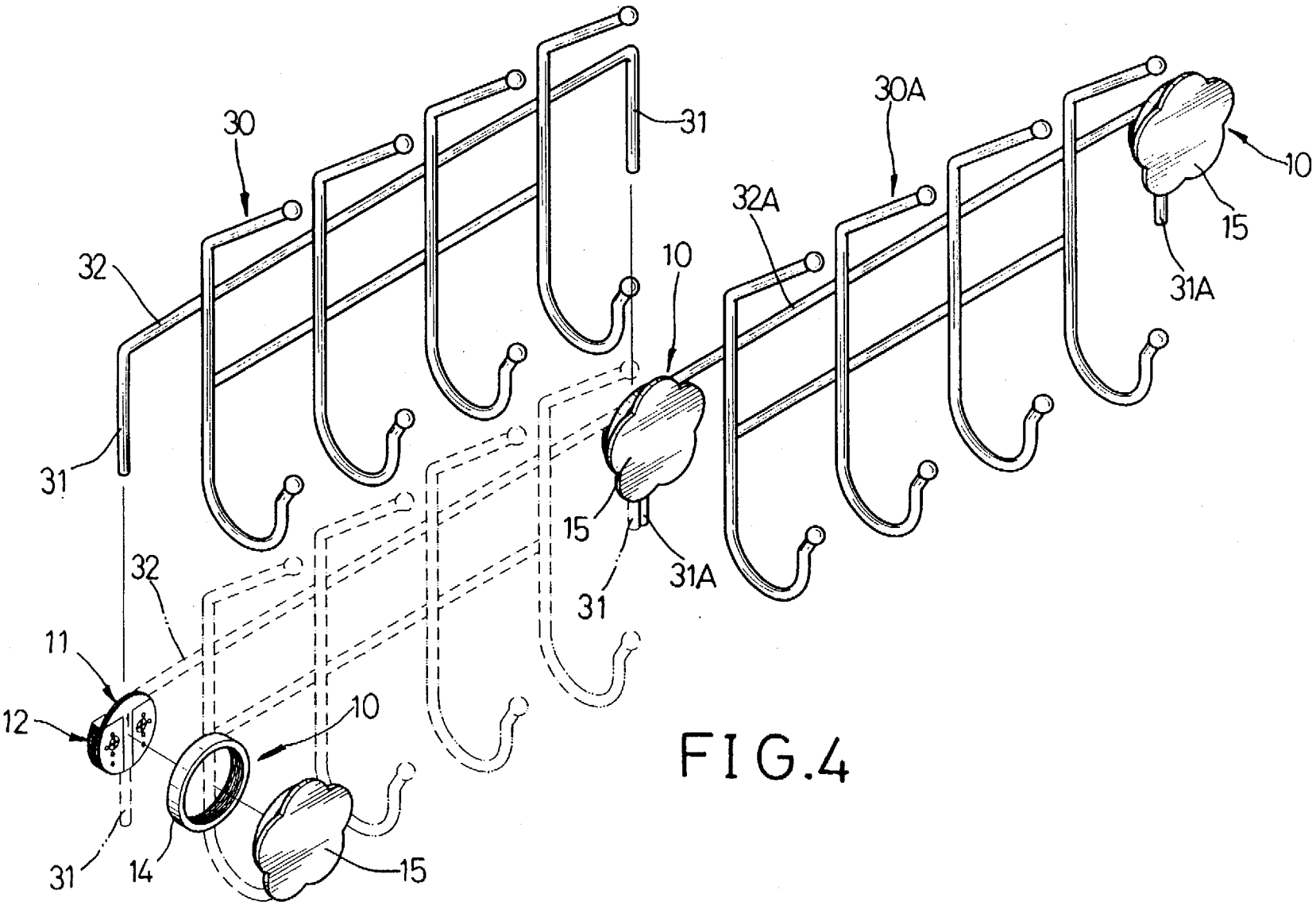
FIG. 4 is an operational view of a plurality of positioning device.

The wall suspension rack 30 can then be moved from a first position as shown in solid lines in FIG. 4 to a second position as shown in phantom lines to be mounted between two base plates 11. The wall suspension rack 30 includes two upright bars 31 each inserted into a respective channel 13 and a horizontal bar 32 abutting on the flat abutting edge 120 of each of the lugs 12 of each of the two positioning devices 10.

The compression ring 14 of each of the positioning devices 10 can then be screwed on the base disk 11 to urge on the upright bar 31 together with the horizontal bar 32, thereby securely positioning the wall suspension rack 30 on the vertical wall 20.

The decorative plate 15 of each of the positioning devices 10 can then be fitted on the compression ring 14, thereby enhancing the aesthetic quality of the positioning devices 10.

Another wall suspension rack 30A including two upright bars 31A and a horizontal bar 32A can also be positioned between two positioning devices 10 to be juxtaposed to the wall suspension rack 30 by means of the above-mentioned process.

By such an arrangement, a plurality of wall suspension racks 30 can be juxtaposed serially.

It is to be noted that the width of the channel 13 of each of the positioning devices 10 is approximately two times of the diameter of each of the upright bars 31 such that the channel 13 can be adapted for receiving two upright bars 31 synchronously.

Figure 1:
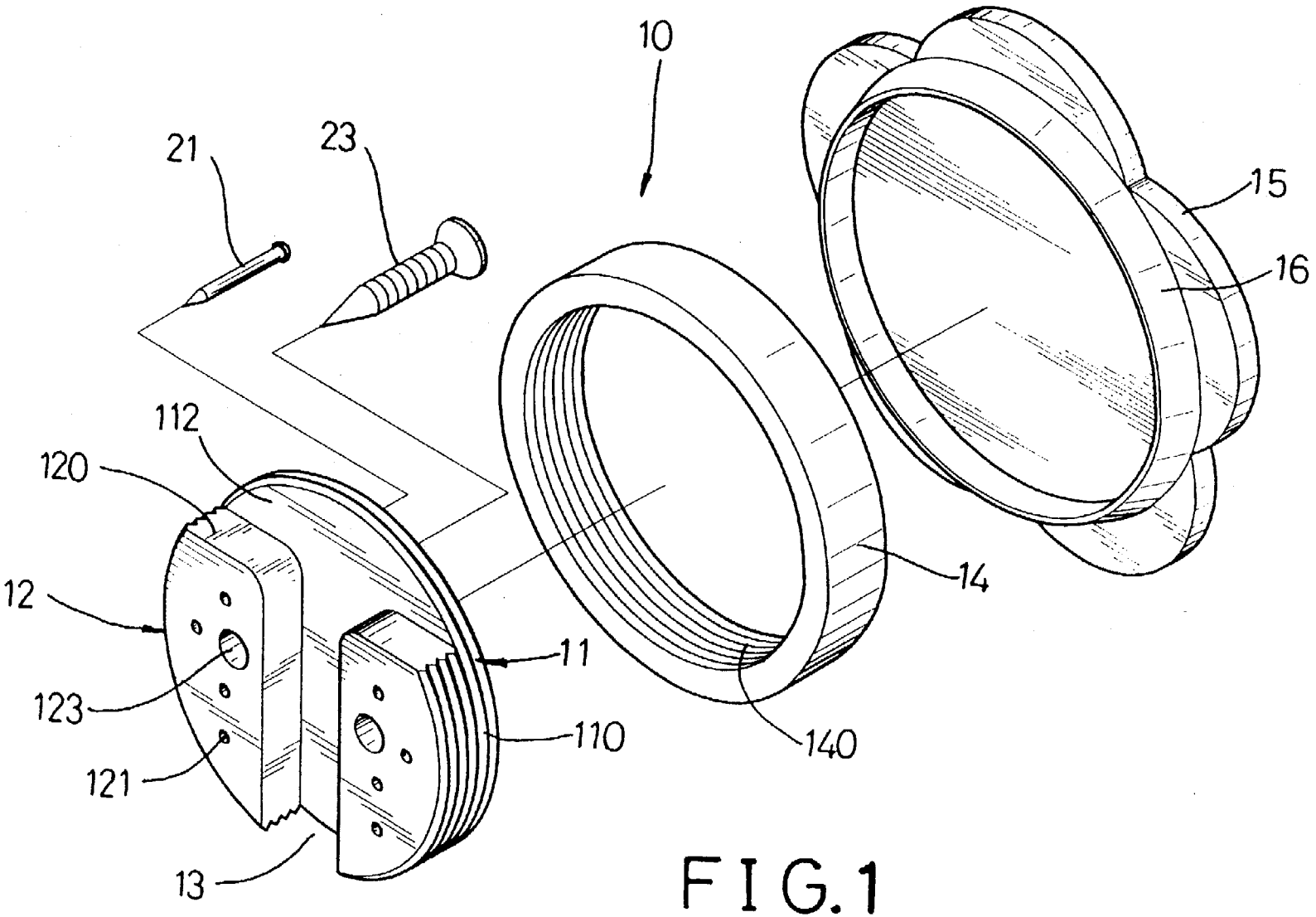
FIG. 1 an exploded view of a positioning device for a suspension rack according to the present invention.
Figure 2:
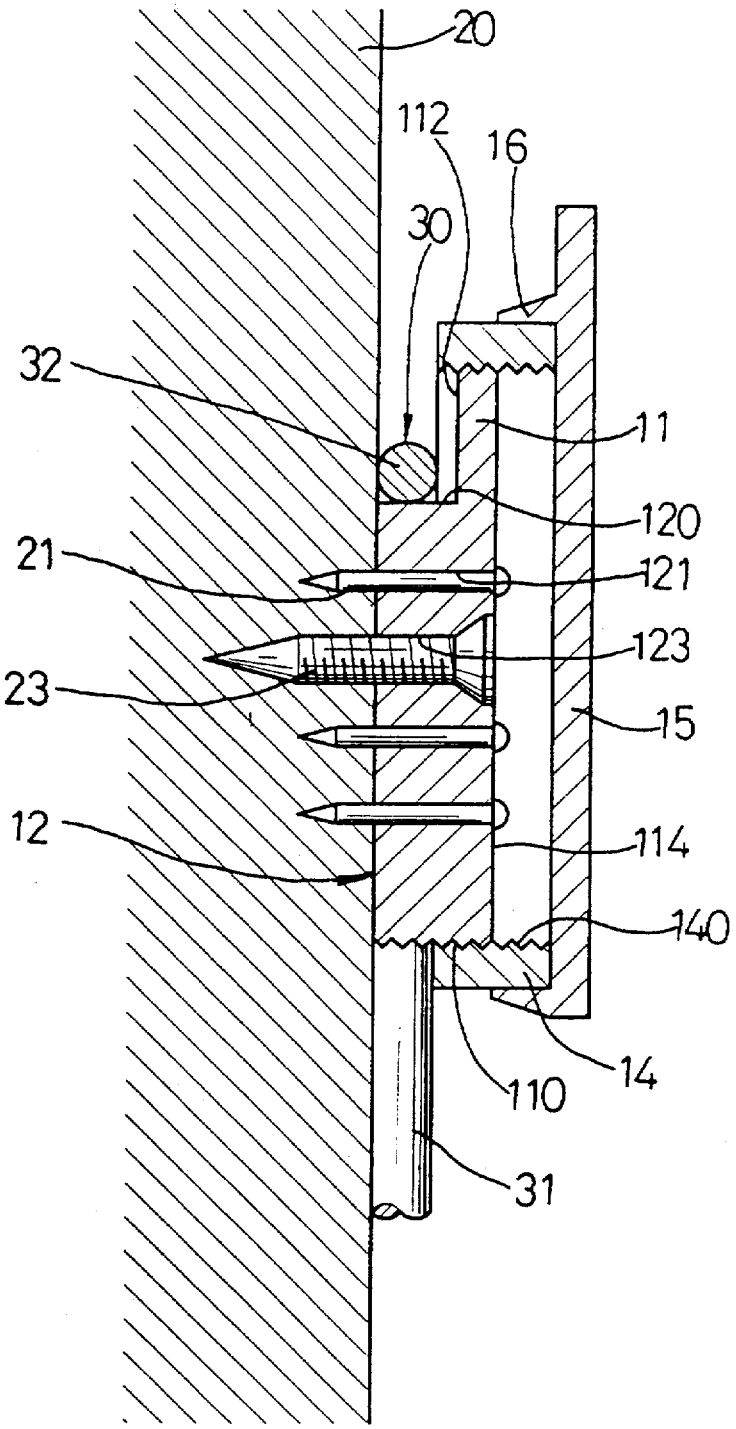
FIG. 2 is a side cross-sectional assembly view of the positioning device shown in FIG. 1.
Figure 3:
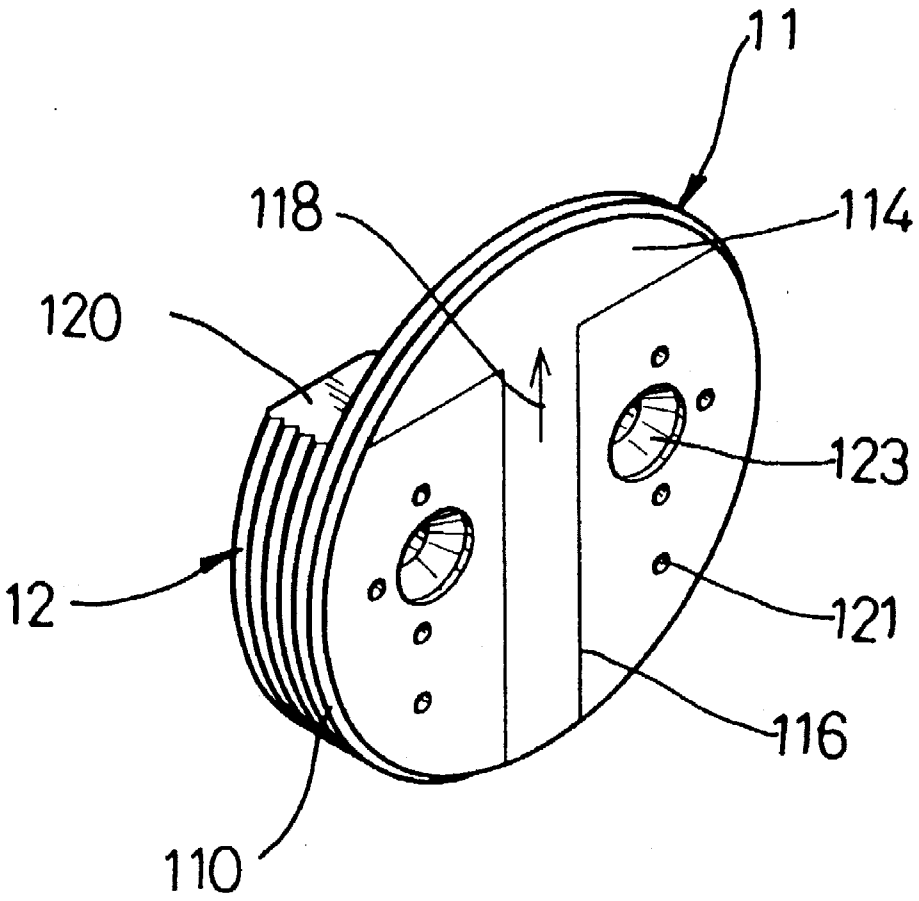
FIG. 3 is a perspective view of a base disk shown in FIG. 1.

Referring now to FIGS. 3 and 4 with reference to FIG. 1, the second side 114 of the base disk 11 is marked with two juxtaposed inverted L-shaped alignment marks 116 each including a first section in line with the abutting edge 120 of each of the lugs 12 and a second section in parallel with each other.

By such an arrangement, a user can dispose the abutting edge 120 of each of the two lugs 12 in a level state by means of locating the first section of each of the alignment marks 116 in a level state, thereby assisting the user when fitting the positioning device 10.

In addition, the second side 114 of the base disk 11 is marked with an indicating arrow 118 located between the second sections of the inverted L-shaped alignment marks 116 so as to indicate a normal direction for assembling the base disk 11.

It should be clear to those skilled in the art that further embodiments may be made without departing from the scope and spirit of the present invention.

What is claimed is:

1. A positioning device comprising:

a base disk (11) including a first side (112), a second side (114), and an outer periphery formed with an outer thread (110);

two juxtaposed lugs (12) each formed on said first side (112) of said base disk (11) and each including a flat abutting edge (120) in line with each other, and a channel (13) defined between said two lugs (12);

a compression ring (14) fixedly mounted on said base disk (11) and including an inner periphery formed with an inner thread (140) threadedly engaged on said outer thread (110); and a decorative plate (15) fitted on said compression ring (14).

2. The positioning device in accordance with claim 1, wherein said decorative plate (15) is formed with an annular flange (16) rotatably fitted on an outer periphery of said compression ring (14).

3. The positioning device in accordance with claim 1, wherein each of said two lugs (12) transversely defines a plurality of holes (121) each extending through said base disk (11), and said positioning device further comprises a plurality of positioning nails (21) each extending through a corresponding one of said holes (121).

4. The positioning device in accordance with claim 1, wherein each of said two lugs (12) transversely defines a bore (123) extending through said base disk (11), and said positioning device further comprises two positioning screws (23) each extending through said bore (123) of a corresponding one of said two lugs (12).

5. The positioning device in accordance with claim 1, wherein said decorative plate (15) is integrally formed with said compression ring (14).

6. The positioning device in accordance with claim 1, wherein said second side (114) of said base disk (11) is marked with two juxtaposed inverted L-shaped alignment marks (116) each including a first section in line with said abutting edge (120) of each of said lugs (12) and a second section in parallel with each other.

7. The positioning device in accordance with claim 6, wherein said second side (114) of said base disk (11) is marked with an indicating arrow (118) located between said second sections of said inverted L-shaped alignment marks (116).

* * * * *